US006032944A

United States Patent [19]

Lee

[11] Patent Number: 6,032,944

[45] Date of Patent: Mar. 7, 2000

[54] PAPER RE-PICKUP METHOD OF IMAGE FORMING APPARATUS

[75] Inventor: Bong-Gi Lee, Kwacheon, Rep. of Korea

[73] Assignee: SamSung Electronics Co., Ltd., Kyungki-do, Rep. of Korea

[21] Appl. No.: 08/825,578

[22] Filed: Mar. 31, 1997

[30] Foreign Application Priority Data

Mar. 29, 1996 [KR] Rep. of Korea ..... 96-9225

[51] Int. Cl.[7] ..... B65H 7/08; B65H 7/07

[52] U.S. Cl. ..... 271/110; 271/258.01

[58] Field of Search ..... 271/110, 258.01, 271/258.03, 265.01

[56] References Cited

U.S. PATENT DOCUMENTS

| | | |
|---|---|---|
| 4,110,032 | 8/1978 | Hubbard et al. . |
| 4,307,957 | 12/1981 | Kitagawa et al. . |
| 4,666,281 | 5/1987 | Miyai et al. . |
| 4,730,823 | 3/1988 | Barela et al. . |
| 4,815,725 | 3/1989 | Kanaya . |
| 4,838,534 | 6/1989 | Ishikawa et al. . |
| 5,081,490 | 1/1992 | Wakao . |
| 5,105,229 | 4/1992 | Ozaki . |
| 5,322,274 | 6/1994 | Takahashi et al. . |
| 5,423,528 | 6/1995 | Teranishi et al. . |
| 5,544,580 | 8/1996 | Takahashi . |
| 5,586,755 | 12/1996 | Hansen . |

OTHER PUBLICATIONS

Merriam–Webster's Collegiat Dictionary, Tenth Edition, Merriam–Webster, Incorporated Springfield, Massachusetts.

C Language for Programmer's, by Kenneth Pugh 1985.

*Primary Examiner*—Donald P. Walsh
*Assistant Examiner*—Daniel K. Schlak
*Attorney, Agent, or Firm*—Robert E. Bushnell, Esq.

[57] ABSTRACT

In a paper re-pickup method for an image forming apparatus, if the initial attempt at paper pickup is unsuccessful, then the paper pickup is re-attempted automatically. The method includes the steps of: picking up the uppermost sheet of printing papers stacked in the automatic paper feeding unit; and checking whether the paper pickup proceeds normally. When the paper pickup does not occur normally, there may be a re-attempting to pick up the papers.

16 Claims, 4 Drawing Sheets

PAPER RE-PICKUP METHOD OF IMAGE FORMING APPARATUS

CLAIM OF PRIORITY

This application makes reference to, incorporates the same herein, and claims all benefits accruing under 35 U.S.C. § 119 from an application entitled Paper Re-pickup Method of Image Forming Apparatus earlier filed in the Korean Industrial Property Office on Mar. 29, 1996, and there duly assigned Serial No. 9225/1996 by that Office.

BACKGROUND OF THE INVENTION

1. Field of the Invention

The present invention relates to an image forming apparatus. More particularly, it relates to a paper pickup method of an image forming apparatus with an automatic paper feeding unit.

2. Description of the Related Art

In an image forming apparatus, if an initial attempt at picking up paper is unsuccessful, then this does not always imply that another attempt to pick up paper would be futile. For a variety of reasons (which are discussed below), another attempt may be appropriate. Thus, a machine with an automatic paper pickup may be useful. An exemplar of the contemporary art on this matter is Hansen (U.S. Pat. No. 5,586,755, Misfeed Detector For A Stack Of Different Weight Sheets, Dec. 24, 1996) discussing an apparatus for detecting sheet misfeed from a tray having at least two sheets whose thickness differs from each other. The thickness of each sheet is detected as it leaves the tray and that value of each sheet is compared to the thickness value in memory for the same sheet when it entered into the tray. Takahashi (U.S. Pat. No. 5,544,580, Mimeographic Printing Machine Having Sheet Jamming Detector, Aug. 13, 1996) discusses a mimeographic printing machine. A jamming detector detects abnormal conveyance of printing sheets in a printing-sheet conveying path. Teranishi et al. (U.S. Pat. No. 5,423,528, Paper Feeding Device, Jun. 13, 1995) discusses a paper feeding device. When a paper jam occurs in the position of the paper feeding roller, the rotation of in one direction of the paper feeding roller is continued, so that the paper feeding roller is returned to its home position. At the time when the paper feeding roller is returned to its home position, the rotation of the paper feeding roller is stopped, to prepare for paper jam processing. Takahashi et al. (U.S. Pat. No. 5,322,274, Sheet Conveying Apparatus, Jun. 21, 1994) discusses a sheet conveying apparatus. In case of jam occurrence, the sheets being conveyed are temporarily accomodated in the standby accomodating portion for discharge and then rejected outside the apparatus after jam return, while an image forming portion carrying out the image formation onto the sheets to be accomodated so that they can be discharged as regular output sheets, and image formation being prohibited when the sheets are discharged, resulting in that the image previously formed on the sheets is not to be discharged. Ozaki (U.S. Pat. No. 5,105,229, Image Recording Apparatus, Apr. 14, 1992) discusses an image recording apparatus. Sheet feeding unit is provided for holding a sheet fed by the sheet feeding unit in accordance with a detection signal from the jam detection unit to reuse the sheet, thereby using a recording sheet efficiently even after a jam has occurred. Wakao (U.S. Pat. No. 5,081,490, Method Of Controlling Image Forming Apparatus When A Jam Occurs In The Original Feeder, Jan. 14, 1992) discusses an image forming apparatus having a recycling original feeder. The steps of operation include detecting a paper jam in the recycling original feeder, determining whether the paper supply unit has started its paper supply operation and then transmitting the sheet material to the sheet receiving member for temporarily storing the sheet material. Ishikawa et al (U.S. Pat. No. 4,838,534, Paper Feed Apparatus, Jun. 13, 1989) discusses a paper feed apparatus. A sensor detects whether the cut sheet has been fed out the cut-sheet conveying section, so that the cut sheets can automatically be fed from the table. Kanaya (U.S. Pat. No. 4,815,725, Paper Feed Control Device For Copier, Mar. 28, 1989) discusses a paper feed control device. A proportional relation between the number of papers fed as counted by a paper counter and the number of encoder pulses which is associated with an amount of the tray is calculated to determine how many pulses will appear before a near paper-end condition is reached. Based on my study of the contemporary practice and art, I find that there is a need for an effective paper re-pickup method for an image forming apparatus, whereby if the initial attempt at paper pickup is unsuccessful, the paper pickup is re-attempted automatically.

SUMMARY OF THE INVENTION

Therefore, an object of the present invention is to provide an improved paper re-pickup method for an image forming apparatus, whereby if the initial attempt at paper pickup is unsuccessful, the paper pickup is re-attempted automatically.

To achieve the above object and other objects, the present invention may consist of a paper pickup method for an image forming apparatus with an automatic paper feeding unit, operating with the steps of picking up the uppermost sheet of printing papers stacked in the automatic paper feeding unit, and checking if the paper pick-up occurs normally. When an error occurs in picking up the paper, there may be a re-attempting to pickup the paper.

The present invention may also consist of a paper pickup method of an electrostatic image forming apparatus with an automatic paper feeding unit, which includes the steps of reading out the number of printing papers pickup re-tries from the image forming apparatus' memory and storing a value corresponding to the number in a paper pickup re-try counter; and decreasing the value stored in the paper pickup re-try counter if there is a command to print. The paper pickup may be performed if the value of the paper pickup re-try counter is decreased.

The present invention may also consist of a paper pickup method of an electrostatic image forming apparatus, which also includes the steps of checking if the paper pickup is normally performed; performing the printing operation if the paper pickup is normally carried out; and if the paper pickup is not normally carried out, checking whether or not the value of the paper pickup re-try counter is zero, and if the paper pickup re-try counter's value is not zero, decreasing the value stored in the paper pickup re-try counter. If the paper pickup re-try counter is zero, an occurrence of paper jam may be displayed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT(S)

Reference will now be made in detail to the preferred embodiment of the present invention, examples of which are illustrated in the accompanying drawings.

Figure 1:
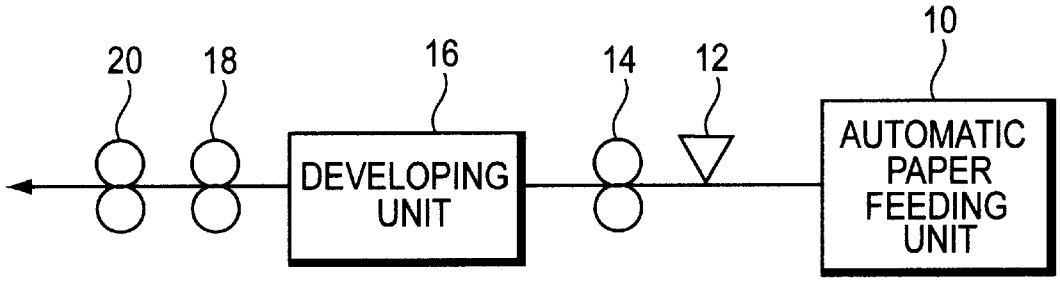
FIG. 1 is a block diagram illustrating a laser beam printer equipped with an automatic paper feeding unit.

Turning now to the drawings, FIG. 1 is a block diagram illustrating the internal paths of a laser beam printer equipped with an automatic paper feeding unit. An automatic paper feeding unit 10 loads printing papers and feeds printing papers to a developing unit 16 by one sheet at a time. The automatic paper feeding unit 10 includes, a paper cassette loading the printing papers, a paper pickup roller for picking up the printing papers stacked in the paper cassette, a paper pickup clutch for controlling the paper pickup roller, and a sensor for monitoring whether there are printing papers in the paper cassette. A paper jam sensor 12 senses whether the printing papers are normally picked up from the paper cassette.

The picked-tip printing papers are conveyed to a developing unit 16 by a register roller 14. The developing unit 16 creates a toner image. A paper coating roller 18 fixes the toner image onto the printing papers by heat and pressure, and a paper delivery roller 20 discharges the printing papers to a top output tray.

Figure 2:
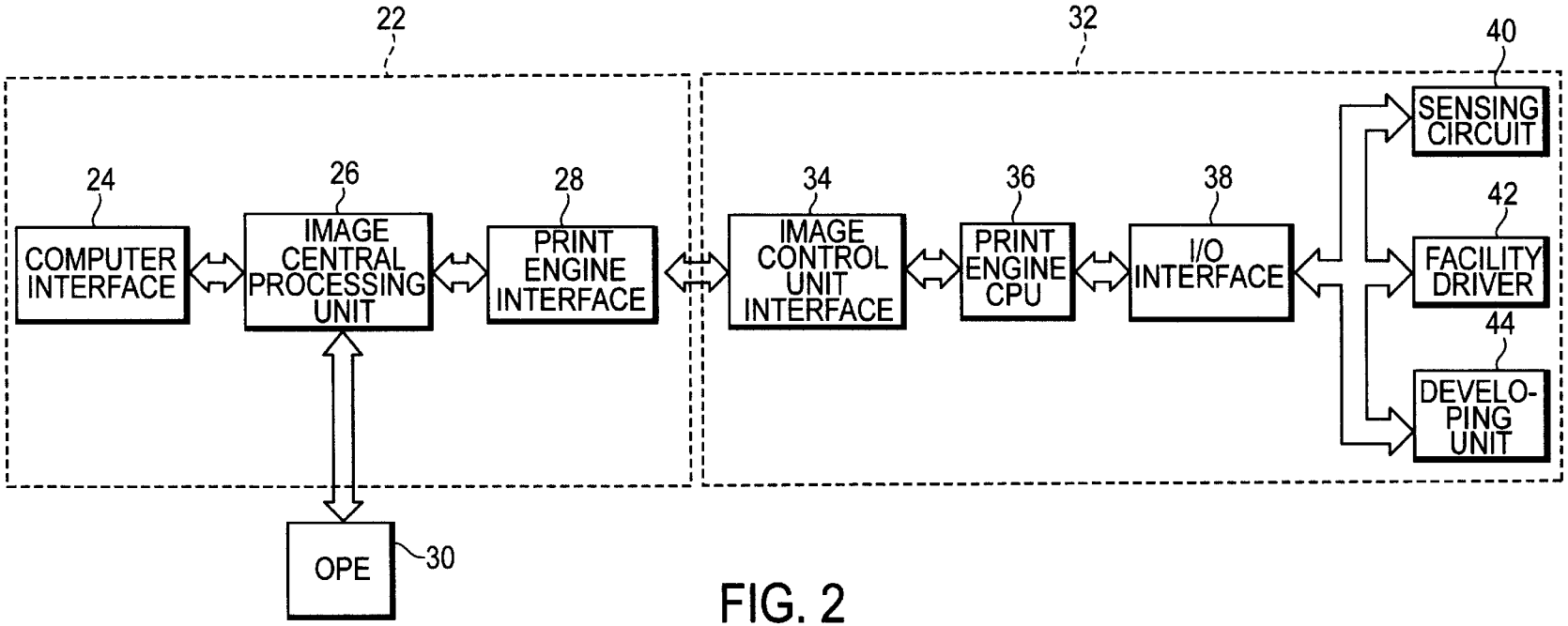
FIG. 2 is a block diagram showing a contemporary laser beam printer.

FIG. 2 is a block diagram illustrating a contemporary laser beam printer. The laser beam printer includes an image control unit 22, a print engine 32, and an operation panel equipment (hereinafter, referred to as OPE) 30.

The image control unit 22 may consist of a computer interface 24, an image central processing unit (CPU) 26, and a print engine interface 28. The computer interface 24 is connected between a host computer and an image CPU 26 to interface input/output signals between the printer and the computer. The image CPU 26 has a read only memory (ROM) which stores a control program in accordance with the present invention, and a random access memory (RAM) that temporarily stores various data produced by the host computer and the OPE 30. The image CPU 26 converts input data from the computer interface 24 to corresponding image data so that it can be processed by the print engine 32 according to a predetermined program, and then sends the converted image data into the print engine 32. The print interface 28 interfaces input/output (I/O) signals to and from the image control unit 34 under the control of the image CPU 26. The OPE 30 includes a set of keys by which commands can be entered into the printer, and a display that displays status information during the printing operation.

The print engine 32 may include an image control unit interface 34, a print engine central processing unit (CPU) 36, an input/output (I/O) interface 38, a sensing circuit 40, a facility driver 42, and a developing unit 44, and is connected to the image control unit 22. The image printer interface 34 links the image control unit 22 with print engine CPU 36. The print engine CPU 36 has control over the facility driver 42 and the developing unit 44, and is itself under the control of the image CPU 26 so that it prints out an image corresponding to the image data received from image control unit 22. The print engine CPU 36 also checks for faults in the operation of the print engine 32 (such as papers feeding, papers conveyance, etc.) through the sensing circuit 40. The sensing circuit 40 controls sensors which monitor the operating state of each of the components, the papers conveyance state, and the amount of toner, and transmits the Output signals from the sensors to the print engine CPU 36. The facility driver 42 actuates various operating components of the laser beam printer used for papers feeding, papers conveyance, and printing operations. The developing unit 44 prints images corresponding to image information from print engine CPU 36.

Figure 3:
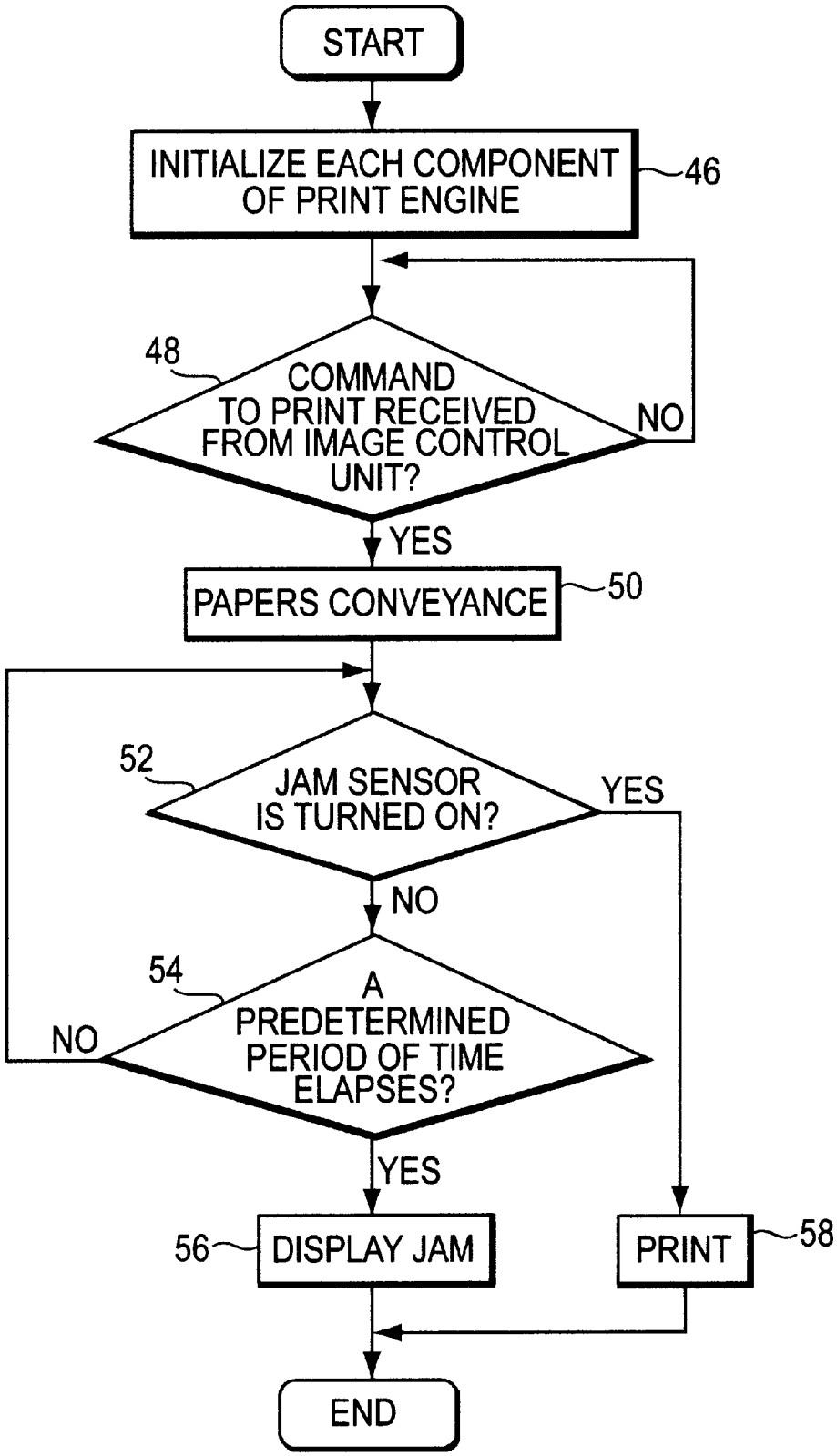
FIG. 3 is a flow chart illustrating control sequence of an automatic paper feeding system of the contemporary laser beam printer.

FIG. 3 is a flow chart of the control process of the automatic paper feeding system for a contemporary laser beam printer.

After power is applied to the laser beam printer of FIG. 2, the print engine CPU 36 initializes each component of the print engine 32 (S46). The print engine CPU 36 detects if a command to print is transmitted from the image control unit 22 (S48). The engine CPU 36 performs Step 50 if the command to print is transmitted therefrom; otherwise, it performs Step 48 and waits for a command to print from the image control unit. The print engine CPU 36 then carries out, a series of papers conveyance procedures to print the papers (S50).

The print engine CPU 36 operates a main motor which powers each roller in the laser beam engine printer. When the main motor operates, the engine CPU 36 actuates a paper pickup clutch to supply a paper pickup roller with power from the main motor. The paper pickup roller contacts the uppermost sheet of papers in the paper cassette. As the paper pickup roller operates, the uppermost sheet of the papers to be printed (hereinafter "printing papers") is fed into the laser beam printer by a friction between the printing papers and the paper pickup roller. The printing papers are conveyed to the developing unit 16 by the register roller 14, which is driven by the main motor.

The paper jam sensor 12 monitors the passage of the printing papers to detect if the printing papers are normally delivered to the register roller 14 from the paper feeding unit 10. When the printing papers are normally delivered to register roller 14, the paper jam sensor 12 forms a closed circuit.

When the papers conveyance procedure starts (S50), the print engine CPU 36 performs Step 52. The print engine CPU 36 determines (S52) if the paper jam sensor 12 is closed. The print engine CPU 36 performs Step 58 provided the paper jam sensor 12 is turned on; otherwise, it performs Step 54. If step 58 is performed, the print engine CPU 36 actuates the developing unit 16 and the paper coating roller 18 so as to print on the printing papers an image Supplied by the image control unit 22. The print engine CPU 36 determines at step 54, however, if a predetermined period of time has elapsed since the papers conveyance started. This predetermined period of time is the time it takes to convey the printing papers picked Lip from the paper feeding unit 10 to the paper jam sensor 12. The print engine CPU 36 goes to Step 56 if the predetermined period of time elapses; otherwise, it repeats Step 52.

Print engine CPU 36 sends a signal indicating the occurrence of the paper jam to the OPE 30, and OPE 30 displays a message informing the user of the jam. The paper jam may be caused by abrasion of the paper pickup roller, instantaneous malfunction of the paper pickup clutch, and the like, which can be solved by repeating the pickup operation. The contemporary way of repeating the pickup operation requires a user to enter the instruction through the keyboard. As described above, according to the contemporary technique, when the initial attempted paper pickup does not occur normally and a paper jam occurs, a user must take the trouble of manually retrying the paper pickup and printing process.

Figure 4:
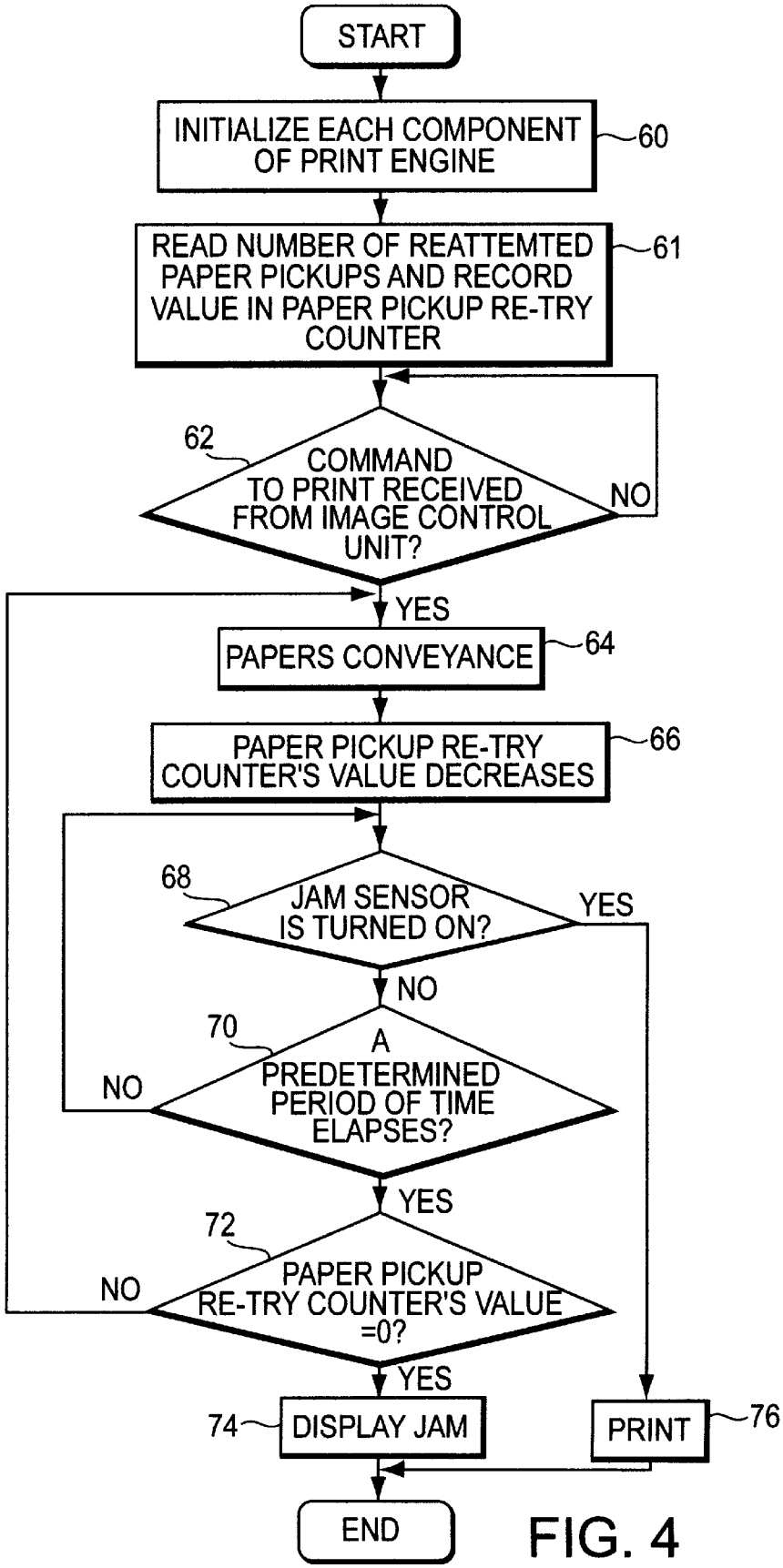
FIG. 4 is a flow chart illustrating the control sequence of a paper feeding system that automatically re-attempts to feed the printing papers following a paper jam in accordance with the present invention.

FIG. 4 is a flow chart of the control sequence of a paper feeding system that automatically re-attempts to feed the printing papers following a paper jam in accordance with the present invention. After power is applied to the laser beam printer, an engine central processing unit (CPU) 36 carries out Step 60 and initializes, each part of the print engine 32. When the initialization step 60 is complete, the print engine CPU 36 proceeds to Step 61.

The print engine CPU 36 includes a memory for storing data regarding the number of re-attempted paper pickup tries, and, reads from the memory the number of re-attempted paper pickups, and records the value in a paper pickup re-try counter (S61). Once the data has been recorded, the print engine CPU 36 checks for a print command transmitted from the image control unit 22 (S62). If a command to print is transmitted from the image control unit 22, the print engine CPU 36 proceeds to Step 64; otherwise, the print engine CPU 36 repeats Step 62 and waits for a print command to be received from the image control unit.

At step 64, the engine print CPU 36 allows the printing papers to be delivered according to a predetermined papers conveyance procedure. Once the papers conveyance procedure starts, the print engine CPU 36 decreases the paper pickup re-try counter's value (S66), which is the number re-attempts at paper pickup. The engine CPU 36 checks if a jam sensor circuit 12 is in a closed position and turned on (S68). When the jam sensor 12 is turned on print, the engine CPU 36 goes to Step 76 and prints the printing papers. If the jam sensor 12 remains open and turned off, the print engine CPU 36 goes to Step 70.

At step 70, the print engine CPU 36 checks if a predetermined length of time has elapsed, which is the time it takes to move the printing papers from a paper feeding unit to the jam sensor 12. Once the predetermined period of time elapses, the print engine CPU 36 goes to Step 72; otherwise, it returns to Step 68. At step 72, the print engine CPU 36 checks if the paper pickup re-try counter's value is zero. When the paper pickup re-try counter's value is zero, the print engine CPU 36 goes to Step 74 and sends a signal indicating the occurrence of a paper jam to OPE 30. If the paper pickup re-try counter's value is not zero, the print engine CPU 36 returns to Step 64 and reattempts to pickup the paper and print it.

If the jam sensor 12 is not closed within a predetermined period of time, even if the papers conveyance procedure is carried out, the paper pickup re-try counter's value is reduced and the papers conveyance procedure is performed again so as to re-attempt to pick up the paper.

The print engine CPU 36 sends a signal indicating a paper jam to the image control unit 22. Image CPU 26 reads the message indicating a paper jam from random access memory. When completed, the image CPU 26 transmits an error message indicating a paper jam to the OPE 30. The OPE 30 displays the error message so as to inform the user of the jam occurrence (S74).

When paper pickup does not perform normally, the paper pickup retry counter is zero and several paper pickup re-attempts have been carried out, the print engine CPU 36 determines that a paper jam has occurred and transmits an error message indicating a paper jam to OPE 30 as described above (S74). Otherwise, the engine CPU 36 operates a developing unit 16 and a paper coating roller 18 (S76) so as to print an image corresponding to image data from the image control unit 22 on paper.

According to the present invention, when the paper pickup is unsuccessful, paper pickup is automatically re-attempted, thereby solving paper jam problems that may result from abrasion of the printer's paper pickup roller, instantaneous malfunction of its paper pickup clutch, and the like.

Therefore, it should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A laser printer, comprising:

a print engine, an image control unit, and a paper feeding unit;

a print engine central processing unit that initializes each component of the print engine of the laser printer and reads a number of attempts of pickup of paper;

a paper pickup re-try counter to store the number of attempts of pickup of paper read by said print engine central processing unit;

said print engine central processing unit starting a conveyance operation to pickup printing papers when a command to print from said image control unit is received by said print engine central processing unit;

said print engine central processing unit changing the value of the paper pickup re-try counter once the conveyance operation begins;

a jam sensor that detects the presence of paper jams;

said print engine central processing unit checking a predetermined period of time that measures the amount of time incurred for the printing papers to move from the paper feeding unit to the jam sensor;

said print engine central processing unit determining whether the paper pickup re-try counter has a zero value; and an operation panel that indicates a paper jam when the value in the paper pickup re-try counter is zero.

2. The printer of claim 1, wherein the printer further comprises:

a laser transmitting a laser beam;

a beam deflector receiving the laser beam from said laser and scanning a paper coating roller having an electrostatic coating; and the paper coating roller transferring a toner image onto a paper.

3. The printer of claim 1, wherein the printer further comprises:

an automatic feeding unit to load the papers and to sequentially feed the papers;

a paper jam sensor sensing whether the papers are being picked up at said automatic feeding unit;

a register roller to receive the papers from said automatic feeding unit and to convey the papers;

a developing unit to receive the papers from said register roller and to create a toner image;

a paper coating roller to receive the papers from said developing unit and to transfer the toner image onto the papers by heat and pressure;

a paper delivery roller to receive the papers from said paper coating roller and to discharge the papers; and an output tray to receive the papers from said paper delivery roller and to store the papers.

4. The printer of claim 3, wherein said automatic feeding unit comprises:

a paper cassette to load the papers;

a paper pickup roller to pick up the papers stacked in said paper cassette;

a paper pickup clutch to control said paper pickup roller; and a feeding sensor to monitor presence of the papers in said paper cassette.

5. The printer of claim 1, wherein the printer further comprises:

an image control unit being connected to a host computer, said operation panel, and said print engine, said image control unit to supply an image to be printed by said printer.

6. The printer of claim 5, wherein said image control unit comprises:

a computer interface being connected to the host computer;

an image central processing unit being connected to said computer interface, said image central processing unit to convert computer data from the host computer into image data usable by said print engine; and a print engine interface connecting said image central processing unit to said print engine.

7. The printer of claim 6, wherein said print engine comprises:

an image control unit interface connecting said print engine to said image control unit;

an engine central processing unit to send print engine instructions in dependence upon the image data and the computer data;

an input and output interface relaying the print engine instructions from said engine central processing unit;

a sensing circuit controlling sensors monitoring operating states of components of the printer according to the print engine instructions;

a facility driver actuating the printer to convey printing papers through the printer according to the print engine instructions; and a developing unit printing according to the print engine instructions.

8. A laser printer, comprising:

a print engine, an image control unit, and a paper feeding unit;

a print engine central processing unit that initializes each component of the print engine of the laser printer and reads a number of attempts of pickup of paper;

a paper pickup re-try counter to store the number of attempts of pickup of paper read by said print engine central processing unit;

a paper pickup roller that picks-up an uppermost sheet of printing papers stacked in the paper feeding unit, checks whether paper pickup occurs, and when the paper pickup does not occur, re-attempts to pickup the paper;

said print engine central processing unit starting a conveyance operation to pickup printing papers when a command to print from said image control unit is received by said print engine central processing unit;

said print engine central processing unit changing the value of the paper pickup re-try counter once the conveyance operation begins;

a jam sensor that detects the presence of paper jams;

said print engine central processing unit checking a predetermined period of time that measures the amount of time incurred for the printing papers to move from the paper feeding unit to the jam sensor;

said print engine central processing unit determining whether the paper pickup re-try counter has a zero value;

an operation panel that indicates a paper jam when the value in the paper pickup re-try counter is zero;

said print engine central processing unit, during said conveyance operation, performs the steps of:

checking whether a jam sensor in the printer detects the presence of the papers;

when the jam sensor does not detect the presence of the papers, then checking whether a predetermined length of time has elapsed after the paper pickup;

when the predetermined length of time has not elapsed, checking again whether the jam sensor detects the presence of the paper; and when the jam sensor does not detect the presence of the paper, re-attempting to pickup the papers.

9. The printer of claim 8, wherein the printer further comprises:

a laser transmitting a laser beam;

a beam deflector receiving the laser beam from said laser and scanning a paper coating roller having an electrostatic coating; and the paper coating roller transferring a toner image onto a paper.

10. The printer of claim 8, wherein the printer further comprises:

an automatic feeding unit to load the papers and to sequentially feed the papers;

a paper jam sensor sensing whether the papers are being picked up at said automatic feeding unit;

a register roller to receive the papers from said automatic feeding unit and to convey the papers;

a developing unit to receive the papers from said register roller and to create a toner image;

a paper coating roller to receive the papers from said developing unit and to transfer the toner image onto the papers by heat and pressure;

a paper delivery roller to receive the papers from said paper coating roller and to discharge the papers; and an output tray to receive the papers from said paper delivery roller and to store the papers.

11. The printer of claim 10, wherein said automatic feeding unit comprises:

a paper cassette to load the papers;

a paper pickup roller to pick up the papers stacked in said paper cassette;

a paper pickup clutch to control said paper pickup roller; and a feeding sensor to monitor presence of the papers in said paper cassette.

12. The printer of claim 8, wherein the printer further comprises:

an image control unit being connected to a host computer, said operation panel, and said print engine, said image control unit to supply an image to be printed by said printer.

13. The printer of claim 12, wherein said image control unit comprises:

a computer interface being connected to the host computer;

an image central processing unit being connected to said computer interface, said image central processing unit to convert computer data from the host computer into image data usable by said print engine; and a print engine interface connecting said image central processing unit to said print engine.

14. The printer of claim 13, wherein said print engine comprises:

an image control unit interface connecting said print engine to said image control unit;

an engine central processing unit to send print engine instructions in dependence upon the image data and the computer data;

an input and output interface relaying the print engine instructions from said engine central processing unit;

a sensing circuit controlling sensors monitoring operating states of components of the printer according to the print engine instructions;

a facility driver actuating the printer to convey printing papers through the printer according to the print engine instructions; and a developing unit printing according to the print engine instructions.

15. A paper re-pickup method of a laser printer including an automatic paper feeding unit, comprising the steps of:

initializing each component of a print engine of said laser printer;

reading a number of attempts of pickup of paper;

storing the number of attempts in a paper pickup re-try counter;

changing the value stored in said re-try counter when receiving a print command;

checking whether the paper pickup occurs normally according to predetermined procedures;

performing the printing operation when the paper pickup occurs normally;

when the paper pickup does not occur normally, checking whether the value of said re-try counter is zero, and when the value of said re-try counter's value is not zero, decreasing the value of said re-try counter; and when the value of said re-try counter is zero, displaying an occurrence of a paper jam.

16. The method according to claim 15, wherein said step of checking whether the paper pickup occurs normally according to predetermined procedures is comprised of the sub-steps of:

checking whether a jam sensor of the printer detects the presence of the papers;

when the jam sensor does not detect the presence of the papers, then checking whether a predetermined length of time has elapsed after the paper pickup; and when the predetermined length of time has not elapsed, checking again whether the jam sensor detects the presence of the paper, and when the jam sensor does not detect the presence of the paper, re-attempting to pickup the papers.

* * * * *